US006846558B2

(12) United States Patent
Pham et al.

(10) Patent No.: US 6,846,558 B2
(45) Date of Patent: Jan. 25, 2005

(54) COLLOIDAL SPRAY METHOD FOR LOW COST THIN COATING DEPOSITION

(75) Inventors: Ai-Quoc Pham, San Jose, CA (US); Robert S. Glass, Livermore, CA (US); Tae H. Lee, Naperville, IL (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 10/059,852

(22) Filed: Jan. 28, 2002

(65) Prior Publication Data

US 2002/0086189 A1 Jul. 4, 2002

Related U.S. Application Data

(62) Division of application No. 09/293,446, filed on Apr. 16, 1999, now Pat. No. 6,358,567.

(60) Provisional application No. 60/113,268, filed on Dec. 23, 1998.

(51) Int. Cl.[7] ..... B32B 9/00

(52) U.S. Cl. ..... 428/336; 428/432; 428/469; 428/702; 428/701; 428/446; 428/698; 428/699; 428/697; 428/310.5; 428/312.2; 428/312.8

(58) Field of Search ..... 428/195, 332, 428/40 P, 469, 689, 697, 702, 632, 633, 210; 416/241 B

(56) References Cited

U.S. PATENT DOCUMENTS 4,745,033 A * 5/1988 Timmons ..... 428/552
5,834,070 A * 11/1998 Movchan et al. ..... 427/126.1
5,851,678 A * 12/1998 Hasz et al. ..... 428/469
6,102,656 A * 8/2000 Nissley et al. ..... 415/174.4
6,143,432 A * 11/2000 de Rochemont et al. ... 428/689
6,187,453 B1 * 2/2001 Maloney ..... 416/241 B

* cited by examiner

*Primary Examiner*—Archene Turner
*Assistant Examiner*—G. Blackwell-Rudasill
(74) *Attorney, Agent, or Firm*—Eddie E. Scott; L. E. Carnahan; Alan H. Thompson

(57) ABSTRACT

A dense or porous coating of material is deposited onto a substrate by forcing a colloidal suspension through an ultrasonic nebulizer and spraying a fine mist of particles in a carrier medium onto a sufficiently heated substrate. The spraying rate is essentially matched to the evaporation rate of the carrier liquid from the substrate to produce a coating that is uniformly distributed over the surface of the substrate. Following deposition to a sufficient coating thickness, a single sintering step may be used to produce a dense ceramic coating. Using this method, coatings ranging in thickness from about one to several hundred microns can be obtained. By using a plurality of compounds in the colloidal suspension, coatings of mixed composition can be obtained. By using a plurality of solutions and separate pumps and a single or multiple ultrasonic nebulizer(s), and varying the individual pumping rates and/or the concentrations of the solutions, a coating of mixed and discontinuously graded (e.g., stepped) or continuously graded layers may be obtained. This method is particularly useful for depositing ceramic coatings. Dense ceramic coating materials on porous substrates are useful in providing improved electrode performance in devices such as high power density solid oxide fuel cells. Dense ceramic coatings obtained by the invention are also useful for gas turbine blade coatings, sensors, steam electrolyzers, etc. The invention has general use in preparation of systems requiring durable and chemically resistant coatings, or coatings having other specific chemical or physical properties.

16 Claims, 3 Drawing Sheets

COLLOIDAL SPRAY METHOD FOR LOW COST THIN COATING DEPOSITION

REFERENCE TO PROVISIONAL APPLICATION TO CLAIM PRIORITY

This application claims priority in provisional application filed on Dec. 23, 1998, entitled "Colloidal Spray Method For Low Cost Thin Film Deposition," Ser. No. 60/113,268, by inventors Ai-Quoc Pham, Tae Lee, Robert S. Glass.

The United States Government has rights in this invention pursuant to Contract No. W-7405-ENG-48 between the United States Department of Energy and the University of California for the operation of Lawrence Livermore National Laboratory.

CROSS-REFERENCE TO RELATED APPLICATIONS

This application is a division of application Ser. No. 09/293,446 filed Apr. 16, 1999, now U.S. Pat. No. 6,358,567, issued Mar. 19, 2002, entitled "Colloidal Spray Method for Low Cost Thin Coating Deposition".

BACKGROUND OF THE INVENTION

1. Field of the Invention

The present invention relates to a coating deposition method based upon colloidal processing technology.

2. Description of Related Art

A coating layer on a substrate, such as a ceramic film (i.e., coating) deposited on a metal or oxide substrate, can be obtained by several methods. Generally such films can be deposited using methods either requiring or not requiring vacuum technology.

Contemporary vacuum deposition techniques can be grouped into two categories: physical vapor deposition (such as sputtering, laser ablation, etc.) and chemical vapor deposition. Both technologies require expensive vacuum pumping equipment. Because of the relatively high cost of capital equipment, such methods are usually not economically viable for high volume applications.

Physical vacuum deposition methods are also limited because the are "line-of-sight." That is, deposition only occurs on the surface of the substrate which can be "seen" by the source. Substrates having a more complex geometry than planar typically are poorly coated, if at all, in a vacuum deposition system. Complex geometrical substrates may be rotated and turned in a vacuum system to achieve more complete surface coverage, although this adds considerable complexity to the system. Chemical vapor deposition is more conformal; however, it often uses toxic and/or expensive chemical reactants. Both physical and chemical deposition techniques generally have low deposition rates for oxide films, typically less than 1 micron per hour.

Contemporary non-vacuum methods of applying coatings to substrates include plasma spraying, tape casting; tape calendering; screen printing; sol-gel coating; colloidal spin or dip coating; electrophoretic deposition; slurry painting; and spray pyrolysis coating. Tape casting and tape calendering are generally limited to planar substrates only. Plasma spraying, slurry painting, and screen printing techniques usually yield coatings with almost certain porosity and are thus more appropriate for applications where a fully dense film is not required. Spray pyrolysis, in which a solution of metal salts or organometallics is sprayed on a heated substrate also generally yields porous films.

Colloidal techniques (spin coating, dip coating, and electrophoretic deposition) are among the most cost-effective techniques known for deposition of dense thin films. These techniques involve the preparation of a colloidal solution of the ceramic powder of the material to be coated.

In the spin coating method, a few drops of the colloidal solution is placed on the surface of the substrate, which is subsequently spun at high speed thereby removing the solvent and leaving a thin layer of the powder on the surface of the substrate. This technique is limited to deposition onto planar substrates having low surface areas.

In electrophoretic deposition, a high voltage is applied between the substrate and a counter electrode, both of which are immersed in the colloidal suspension. The powder particles, which are generally slightly charged on the surface, move under the electrostatic potential toward the substrate where they discharge and deposit. This technique is limited to conductive substrates only.

In the dip coating process, the substrate is dipped into the colloidal solution followed by withdrawal and drying. During the air-drying step, the solvent evaporates, leaving the powder in the form of a thin film on the substrate.

It has been extremely difficult, if not impossible, to deposit coatings with thicknesses larger than a few microns, using conventional dip coating methods. The films obtained are generally limited in thickness, typically a few microns, but less than ten microns. Attempts to deposit thicker coatings have not generally been successful because of film cracking, particularly during the drying process. The drying step in a conventional colloidal dip coating process is done after withdrawing the substrate from the solution. During the drying step the solvent evaporates which induces film shrinkage due to a large volume change which in turn leads to cracking. In order to deposit coatings thicker than 10 microns, the coating process must be repeated, which is both time consuming and costly.

In addition, all the colloidal processing techniques require subsequent sintering at high temperature in order to densify the film. The process of thermal cycling of the substrate from room temperature to the sintering temperature, can cause cracking between the successive layers because of differential rates of thermal expansion.

Accordingly, a need exists for coatings on substrates that can be relatively dense, are essentially crack-free, yet sufficiently thick (i.e., greater than 10 $\mu$m), and preparable in a single dispersion step.

SUMMARY OF THE INVENTION

It is an object of the present invention to produce dense coatings on various substrates.

A further object of the invention is to provide coatings on various substrates in a single processing step.

Another object of the invention is to provide a dense or porous coating on a substrate.

Another object of the invention is to provide coatings of single phase materials or a composite of various materials such as oxide, nitride, silicide, and carbide compounds.

Another object of the invention is to provide coatings at low cost compared to conventional thin film deposition techniques.

Another object of the invention is to provide coatings prepared by spraying with an ultrasonic atomizer.

Another object of the invention is to provide coatings of two or more materials with a graded composition through at least one portion of the coating.

Another object of the invention is to provide coatings on substrates that substantially reduce the stress at the interface between coating and substrate.

The present invention is a new colloidal coating deposition method that can produce dense (i.e., greater than about 90% of theoretical density), crack-free coatings at virtually any thickness ranging from less than one micron to several hundred microns in a single deposition step. The present invention includes the preparation of a stable colloidal solution containing a powder of the material to be coated and a carrier medium (e.g., solvent) prior to deposition. Subsequently, the colloidal solution (e.g., colloidal suspension) is then sprayed on the substrate to be coated, using a spraying device, preferably an ultrasonic nebulizer. The substrate is heated to a temperature higher than the boiling point temperature of the solvent, which hastens evaporation of the solvent, leaving the powder in the form of a compact coating layer. Deposition of the coating onto a heated substrate is critical to the formation of a thick coating without cracks. Also, a fine and uniform spray obtained using ultrasonic nozzles is an important feature in the formation of high quality coatings.

To facilitate solvent evaporation, the solvent used in the subject invention is preferably chosen from among those having sufficiently high volatility. When water must be used, an organic solvent is often added to increase solvent volatility and enhance surface wetting properties.

The method of the invention can be termed Colloidal Spray Deposition (CSD). CSD allows the deposition of thin, thick, or complex coatings that have generally been unattainable heretofore. Using the present method, a coating several microns to several hundred microns in thickness can easily be prepared using a single step. The coating can encompass a dense, or porous sintered particle layer that matches the desired application. By controlling the composition of the colloidal solution delivered to an ultrasonic nozzle, coatings with either simple or complex structures can be created, such as composites of different materials or coatings with graded compositions, including continuously graded or discontinuously graded, including stepped compositions. For example, by controlling the feed rates of the colloidal solutions into the nozzle for each of the constituent particle sources, the concentration of the ceramic composites may be continuously graded from one (or more) composition(s) to another.

An advantage of the invention is that it provides coatings for several applications, including solid oxide fuel cells, gas turbine blade coatings, sensors, surface catalyst coatings, steam electrolyzers, and in any application where an chemically inert protective coating of oxide, silicide, nitride or carbide material is desired.

BRIEF DESCRIPTION OF THE DRAWINGS

FIG. 5 illustrates a cross-section of a composite coating with a graded composition that can be processed using the inventive method described herein.

DETAILED DESCRIPTION OF THE INVENTION

Figure 1:
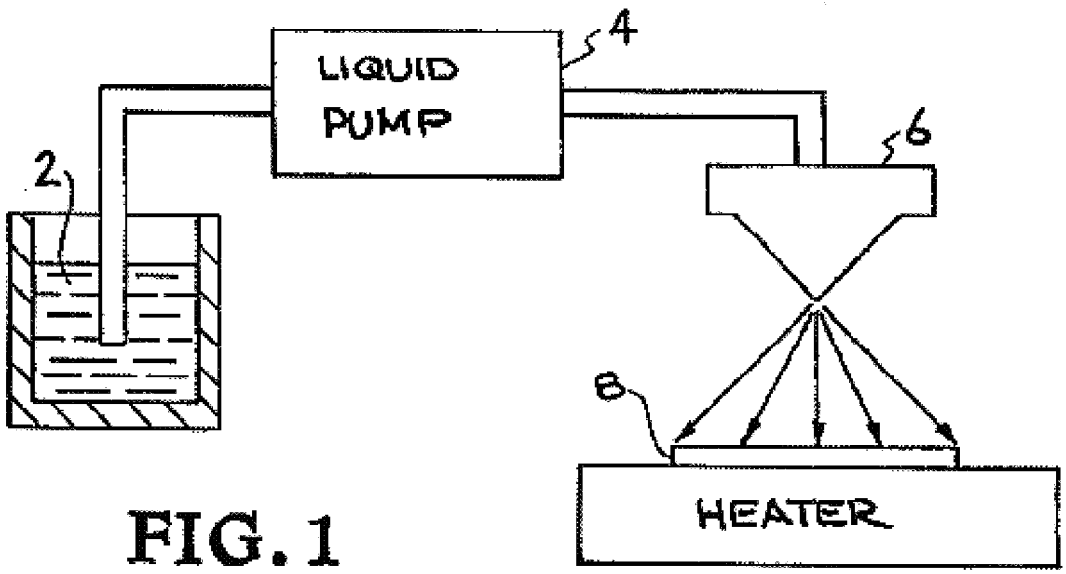
FIG. 1 illustrates a schematic of the inventive method of generating thin coatings having thickness of less than one $\mu$m to thick coatings having a thickness of several hundred microns.

The present invention involves a method for depositing a coating onto a substrate and novel coating compositions and structures that can be produced by the method. The coating is derived from the deposition of fine particles that are dispersed (usually sprayed) onto a heated substrate. FIG. 1 illustrates a general depiction of the method of the invention. A colloidal sol (2) is delivered via a pumping means such as a liquid pump (4) to a liquid dispersing means such as an ultrasonic nozzle (6) that sprays a mist of fine droplets onto a substrate (8) that has been heated to a desired temperature by a heating means such as heater (10) which may contact the substrate. The particles are dispersed onto the substrate as a mist of droplets of the mixture, with the droplets usually being of maximum cross-sectional dimension of less than 100 microns, and preferably from about 20 to about 50 microns. Although any means that can effectively disperse (e.g. spray) such small droplets may be employed, ultrasonic spraying is a preferred mode.

Although not evident in FIG. 1, prior to deposition one step of the method involves heating the substrate close to or above the boiling point of the solvent. Upon impact of the droplets on the heated substrate, the solvent evaporates leaving the powder in the form of a compact layer of the particles, i.e., a green film. The essentially instantaneous removal of the solvent by heating allows a continuous deposition of the coating. Following the coating step, the substrate and the coating can be co-sintered at high temperature to form a fully dense, sintered coating.

A substrate comprising any material may be coated by the method, including for instance, glasses, metals, ceramics, and the like. However, the best results are usually obtained with substrates having at least some porosity. The substrate surface can have any shape, including planar or non-planar surfaces. The substrate can have a low surface area to be coated or the method of the invention can be scaled up to coat objects of very large surface areas.

The solvent employed to suspend the particles can be an organic liquid, aqueous liquid or a mixture of both. The selection of the solvent is determined by the material(s) to be coated as well as the substrates. The solvent must be compatible with the powder (i.e., particles) of the coating material so that a stable colloidal dispersion can be obtained. The solvent must have sufficient volatility so that it can easily be removed when the spray impinges on the heated substrate. Organic solvents such as ethanol, acetone, propanol, toluene are most commonly used. In general, a dispersant, a binder and/or a plasticizer are introduced into the solvent as additives. The dispersant aids in stabilizing the colloidal suspension; the binder adds some strength to a green film initially formed on deposition onto the substrate; and the plasticizer imparts some plasticity to the film. Such practices are known in conventional colloidal processing techniques.

Normally the substrate is heated in the range from about room temperature to about 400° C., but in any case, the substrate is held at a temperature lower than the temperature at which the particles chemically decompose into simpler converted products, such as those which may occur in a spray pyrolysis process. Furthermore, if an organic carrier medium is used, the temperature must be below that which would destroy the organic by breaking bonds, or by chemical reactions with the atmospheric elements to which the organic is exposed. Therefore, the organic liquids useful as carrier media normally have a boiling point below about 400° C. at standard temperature and pressure (STP).

Although the substrate is heated, the dispersing of the particles, such as by spraying or aerosol-assisted deposition, is usually conducted under ordinary conditions of temperature and pressure, such as 25° C. and 1 atmosphere pressure (RTP).

Most powders of any material that have small enough particle size can be suspended in an appropriate solvent as a colloidal suspension for coating. The primary requirement for a stable colloidal solution or suspension is to obtain a powder form of the material to be coated (element or compound) and an average particle size of such material that is sufficiently small enough. Usually fine particles of the material to be coated are less than 10 microns, but in some instances they must be less than 1 micron and even less than 0.5 micron. Although any concentration of particles can be suspended in the carrier medium (i.e., solvent), usually the concentration is in the range from about 0.1 to 10 weight percent, of particles in the solvent.

The materials that can be considered for coating using the subject invention include any pure or mixed metals or compounds, particularly ceramic precursor materials, as for example, all metals, metal oxides, carbides, nitrides, suicides, and the like. Preferred compounds include the elements Y, Zr, elements 57–71, Al, Ce, Pr, Nd, Pm, Sm Eu, Gd, Tb, Dy, Ho, Er, Tm, Yb, Lu, Sc, Ti, V, Cr, Mn, Fe, Co, Ni, Cu, Zn, Bi, Th, Pb, O, C, N, and Si. Although single phase materials can be coated onto the substrate, composite or multilayer coatings are also obtainable.

Multilayer coatings can be created using sequential processing of different colloidal solutions, each containing one or more compositions desired in the final coating. The solutions can be delivered to a single nebulizer via different liquid pumps or through different nebulizers. The compositions of the multilayers can be graded in a continuous or discontinuous manner. A coating of continuously graded or discontinuously graded (including stepped) composites can be processed by codepositing different solutions onto a substrate. For example, a coating with a graded composition structure can be processed by simultaneously processing different solutions and controlling the pumping speed of the different solutions through the same or different nebulizers, as illustrated in an example provided below.

After the particles have been dispersed upon the substrate, the resulting green film is sintered at times and temperatures sufficient to produce a final coating having desired properties. Generally, dense coatings require higher sintering temperatures, with fully dense coatings requiring the highest. If a porous coating is desired, the sintering temperature must be kept sufficiently low to avoid total densification due to particle growth.

Figure 2:
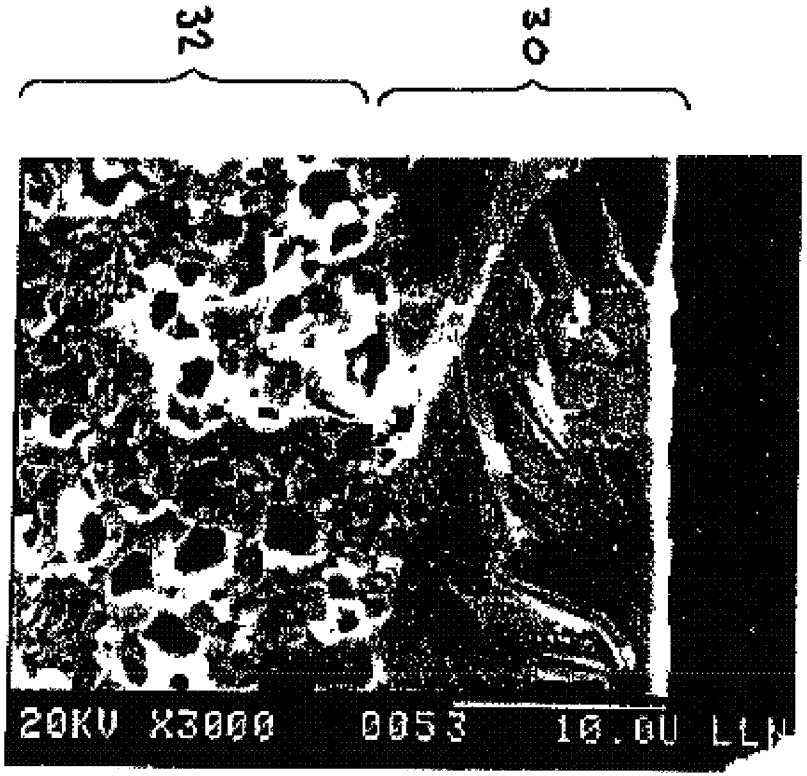
FIG. 2 illustrates a Scanning Electron Microscope (SEM) micrograph of a cross-section of a 13 micron thick of Yttria-Stabilized-Zirconia (YSZ) coating applied over a porous Ni/YSZ substrate using the inventive method described herein. The coating is approximately fully dense, has no cracks, and has excellent adhesion to the substrate.

A desirable feature of the invention is that the sintered coating can be relatively thick and yet crack free. The coatings also have excellent adhesion to the substrate. Although the thickness of the coating can be varied in the range of less than 1 micron to several hundred microns by controlling the deposition time, the thickness is usually up to about 250 microns, and preferably about 1 to about 100 microns; however, thicknesses of the coating greater than 10 microns, greater than 20 microns, and greater than 40 microns can be conveniently produced by controlled dispersion of the colloidal solution and a single sintering step. FIG. 2 illustrates a Scanning Electron Microscope (SEM) micrograph of a 13 micron thick yttria-stabilized zirconia (YSZ) coating applied onto a porous Ni/YSZ substrate using the inventive method described herein. The coating is dense, has no visible cracks, and has excellent adhesion to the substrate material.

Figure 3:
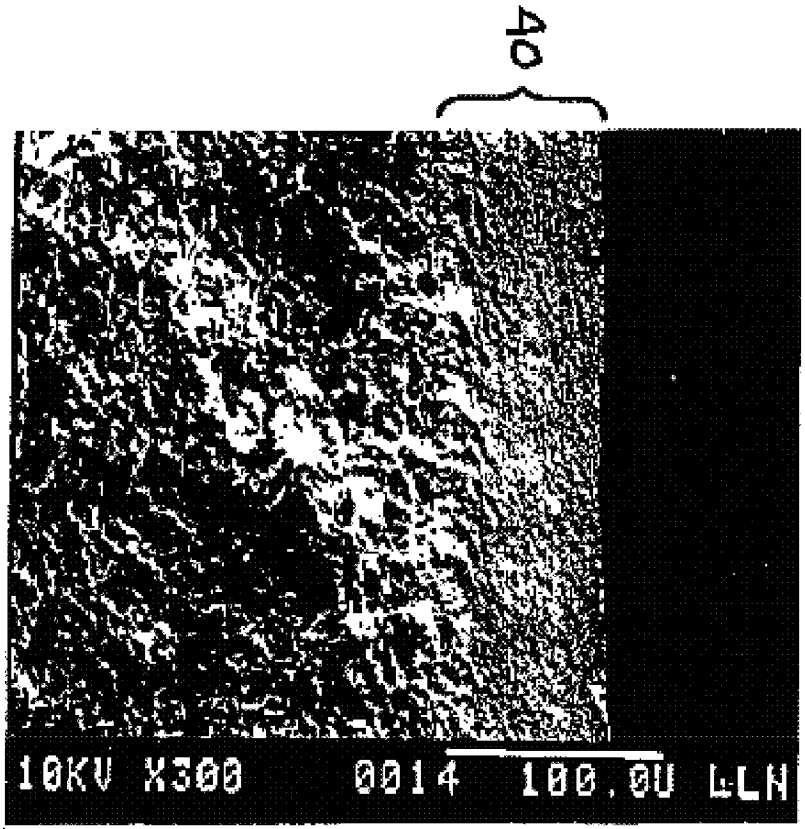
FIG. 3 is an SEM micrograph illustrating a cross-section of an 80 micron thick coating of YSZ deposited on a porous (La, Sr) $MnO_3$ substrate using the method of the invention. The coating is essentially fully dense, has no cracks, and has excellent adhesion to the substrate.

A thicker coating is exemplified in FIG. 3 wherein a SEM micrograph illustrates an 80 micron thick coating of YSZ deposited on a porous $La_{0.85}Sr_{0.15}MnO_3$ substrate using the method of the invention. Although much thicker, the coating has characteristics similar to that of the micrograph shown in FIG. 2, i.e., the coating is dense, has no visible cracks, and has excellent adhesion to the substrate material.

Figure 4:
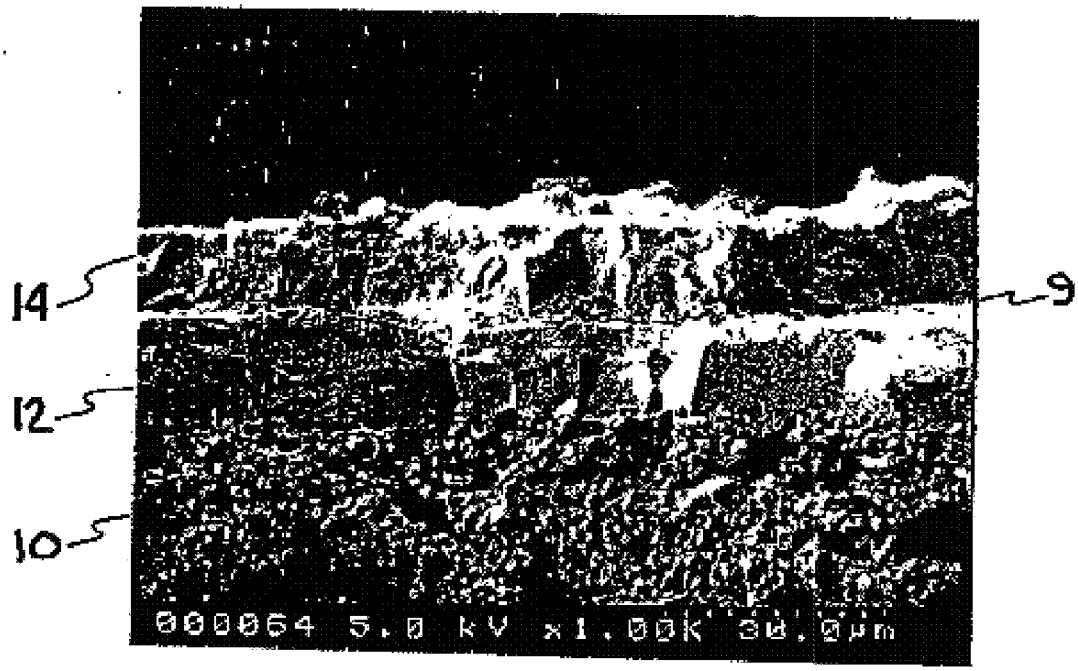
FIG. 4 is a SEM micrograph showing a cross-section of a porous substrate coated with a YSZ and yttria-doped-ceria bilayer.

In conventional methods for the processing of multilayer coatings, the thermal expansion coefficient mismatch between the adjacent layers often creates mechanical stresses that can lead to film cracking and/or delamination. For example, FIG. 4 is a SEM micrograph showing a porous substrate 10 coated with a YSZ (12) and yttria-doped-ceria (14) bilayer. Such a structure can be used as an anode in a fuel cell. A clear delamination can be observed at the interface between the two layers of the coating.

In the invention, the desirable capability to produce a coating having more than one layer without delamination or cracking is enhanced. One solution to prevent cracking or delamination is to reduce the stress at the interface between the two layers of the coating, i.e., to alleviate thermal expansion mismatch between layers. This can be done by replacing the abrupt interface between the two layers with a transition zone where the composition of the coating would change progressively and smoothly from pure YSZ to pure yttria-doped-ceria. Such a transitional layer can be a composite which is a composition that is graded, often in a continuous manner across the cross-section of the layer or entire coating, although discontinous or stepped concentrations are possible.

Figure 5A:
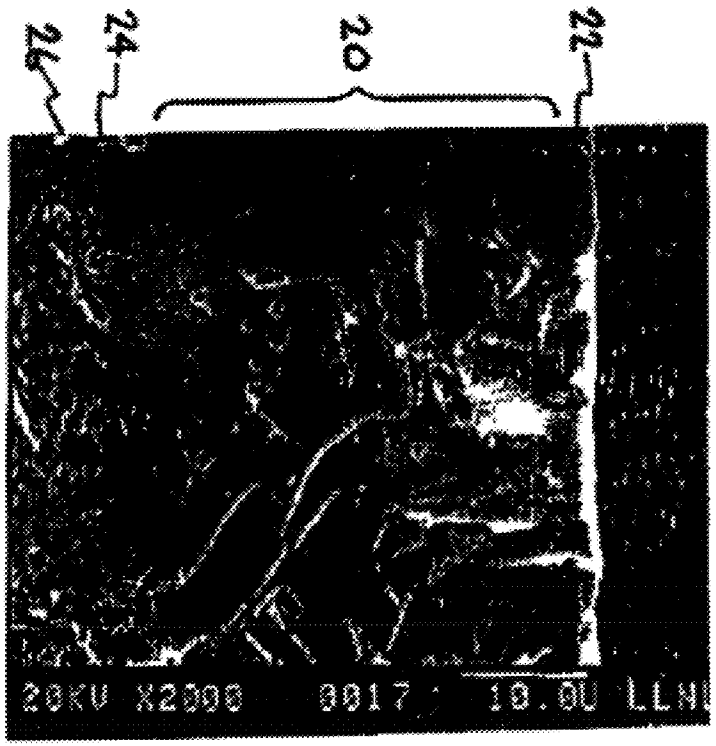
FIG. 5*a* shows the SEM micrograph of the cross-section of the coating. The film has a YSZ layer and an yttria-doped ceria layer separated by a transition zone where the coating composition manifests a continuously graded compositional layer changing composition from a majority of YSZ to a majority of yttria-doped-ceria.
Figure 5B:
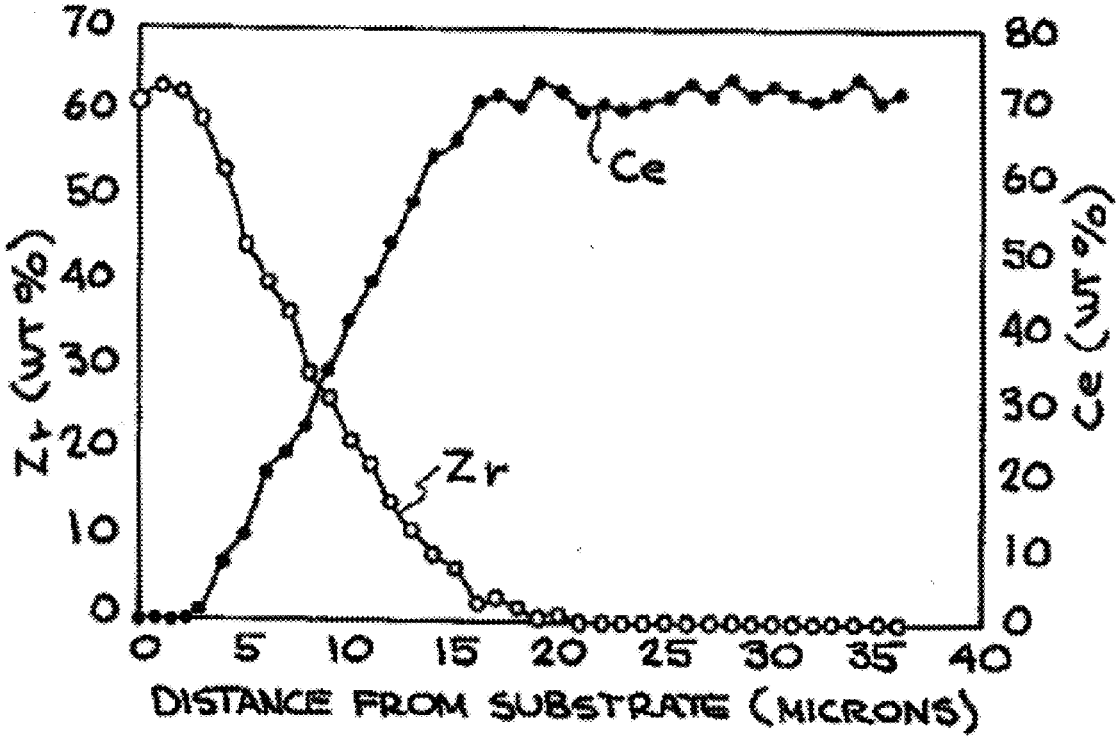
FIG. 5*b* shows the elemental composition profile of the cross-section of the coating going from one side to the other as determined using an electron microprobe. A monotonic transition is clearly observed.

By using the method of the invention, a graded composition can easily be produced. By controlling the delivery rate and concentrations of each of more than one colloidal solution, using for instance, programmable liquid pumps, the concentration of the composition of the liquid delivered to a single nebulizer (or the rate of delivery of different solutions to separate nebulizers) can be predetermined or controlled in order to create a composite coating with the desired (predetermined) graded composition. A composite coating of any number of compounds can be created using this method. FIGS. 5*a* and 5*b* provide an illustration of a coating with a graded composition fabricated by using this method. FIG. 5*a* shows the SEM micrograph of the coating. The coating on porous anode substrate 26 has a YSZ layer 24 (adjacent the anode) and a yttria-doped ceria layer 22 (exterior) separated by a transition zone 20 where the coating composition changes gradually and monotonically from essentially YSZ to essentially yttria-doped-ceria. In contrast to the structure shown in FIG. 4, FIG. 5*a* illustrates a graded composition structure that does not have a clear interface between the layers. Delamination has also been suppressed, indicating that the graded transition zone has been effective for relaxation of the stress at the interface between YSZ and yttria-doped-ceria. FIG. 5*b* shows the elemental composition profile of the coating going from one side to the other, i.e., from the surface adjacent the substrate to the exterior surface of the coating (or nonadjacent surface to the substrate), as determined using an electron microprobe. A compositionally varying, yet smooth transition is clearly observed in FIG. 5*b* wherein the concentration of the zirconia-containing material gradually decreases in the transition layer from above about 60 weight percent down to about zero weight percent and the concentration of the cerium-containing material increases from zero to about 70 weight percent, in an initial 20 micron cross-section of the coating adjacent the substrate.

The method and the material structures obtainable using the method described here have useful applications in a number of areas, especially in preparation of solid oxide fuel cells, gas turbine blade coatings, sensors, steam electrolyzers, etc. It has general use in preparation of systems requiring durable and chemically resistant coatings, or coatings having other specific chemical or physical properties.

Although particular embodiments of the present invention have been described and illustrated, such is not intended to limit the invention. Modifications and changes will no doubt become apparent to those skilled in the art, and it is intended that the invention only be limited by the scope of the appended claims.

What is claimed is:

1. A composition comprising:

a substrate having a surface;

a thin crack-free coating material on said surface of said substrate, said thin crack-free coating material comprising a graded concentration of a first ceramic composite and a graded concentration of a second ceramic composite, said thin crack-free coating material having a thickness of about 1 to about 100 microns and a density greater than that of said substrate, and a transition zone between said first ceramic composite and said second ceramic composite wherein said transition zone comprises a transition zone composite that changes progressively from said first ceramic composite to said second ceramic composite.

2. The composition of claim 1 wherein at least one of said first or second ceramic composites comprises ceria or zirconia.

3. The composition of claim 1 wherein said thin crack-free coating material comprises at least one element selected from the group consisting of Y, Zr, Al, Ce, Pr, Nd, Pm, Sm, Eu, Gd, Tb, Dy, Ho, Er, Tm, Yb, Lu, Sc, Ti, V, Cr, Mn, Fe, Co, Ni, Cu, Zn, O, C, N, and Si.

4. The composition of claim 1 wherein said thin crack-free coating material comprises an oxide, carbide, nitride or silicide selected from the group consisting of Zr, Y, La, a rare earth element of atomic number from 58 through 71, a transition element of atomic number from 21 through 30 and Al.

5. The composition of claim 1 wherein said thin crack-free coating material comprises an oxide.

6. The composition of claim 1 wherein said transition zone composite has a continuous graded composition.

7. The composition of claim 1 wherein said transition zone composite has a discontinuous graded composition.

8. The composition of claim 1 wherein said thin crack-free coating material comprises a thickness of greater than 10 microns and less than 100 microns.

9. The composition of claim 1 wherein said thin crack-free coating material comprises a thickness in the range of about 10 microns to about 40 microns.

10. The composition of claim 1 wherein said thin crack-free coating material comprises a thickness of about 80 microns.

11. The composition of claim 1 wherein said substrate is selected from the group consisting of glass, metal and ceramic.

12. The composition of claim 1 wherein said substrate is porous.

13. The composition of claim 12 wherein said thin crack-free coating material comprises yttria-stablized zirconia.

14. The composition of claim 12 wherein said thin crack-free coating material comprises yttria-doped ceria.

15. The composition of claim 12 wherein said transition zone composite comprises a transition zone containing yttria-stabilized zirconia and yttria-doped ceria.

16. The composition of claim 1 wherein said transition zone composite has a stepped composition.

* * * * *